US007074290B2

(12) United States Patent
Miyazaki et al.

(10) Patent No.: US 7,074,290 B2
(45) Date of Patent: Jul. 11, 2006

(54) CUSHIONING MATERIAL FOR PACKAGING AND METHOD AND DEVICE FOR MANUFACTURING THE CUSHIONING MATERIAL

(75) Inventors: Yoshihito Miyazaki, Kitakyushu (JP); Toshiyuki Hashiuchi, Tokyo (JP)

(73) Assignee: Altech Co., LTD, Tokyo (JP)

( * ) Notice: Subject to any disclaimer, the term of this patent is extended or adjusted under 35 U.S.C. 154(b) by 435 days.

(21) Appl. No.: 10/442,230

(22) Filed: May 21, 2003

(65) Prior Publication Data

US 2003/0201062 A1 Oct. 30, 2003

Related U.S. Application Data

(62) Division of application No. 09/926,823, filed as application No. PCT/JP00/02743 on Apr. 26, 2000, now abandoned.

(51) Int. Cl.
*B31F 1/00* (2006.01)
*B31F 7/00* (2006.01)

(52) U.S. Cl. ..... 156/227; 156/204; 156/226; 493/413

(58) Field of Classification Search ..... 156/200, 156/204, 211, 226, 227, 463, 474; 493/397, 493/399, 405, 413, 414, 422, 430, 433, 437–440, 493/446–449, 457, 966, 967
See application file for complete search history.

(56) References Cited

U.S. PATENT DOCUMENTS 2,933,122 A * 4/1960 Christman ..... 72/341
2,950,038 A 8/1960 Rupp (Continued)

FOREIGN PATENT DOCUMENTS

EP 320479 A2 * 6/1989

(Continued)

OTHER PUBLICATIONS

Kayane et al., JP 08034477A, Feb. 6, 1996, (Japanese & Derwent abstracts; and Japanese machine translation).

(Continued)

*Primary Examiner*—Gladys JP Corcoran
(74) *Attorney, Agent, or Firm*—Westerman, Hattori, Daniels & Adrian, LLP.

(57) ABSTRACT

A recyclable cushioning material for packaging obtained by forming a cushioning material for packaging used to protect articles supplied for physical distribution from being impacted with one sheet of corrugated fiberboard and a method and device for manufacturing the cushioning material, wherein a plurality of cutting lines (11 to 21) are formed in one sheet of corrugated fiberboard (10) in parallel with each other in the direction perpendicular to a direction in which the pleats of the corrugated fiberboard extend and a plurality of connection parts (25) are formed intermittently on each of these cutting lines so that a plurality of unit corrugated fiberboard (41 to 52) can be folded up alternately each other, openings (30 to 33) including the cutting lines are formed in the plurality of unit fiberboard (46 to 52) located on the inner side, and zig-zag foldings at the cutting lines (11 to 21) in which hump-folds and trough-folds are formed alternately each other are performed simultaneously by a zig-zag folding device (70), and the pleats are glued with gluing nozzles (82, 83) and pressed by a cylinder (87) so as to connect and stack the unit corrugated fiberboard (41 to 52) to each other, whereby the cushioning bodies for packaging (57 to 60) formed of a corrugated fiberboard stacked body having an article supporting part (55) can be assembled automatically.

3 Claims, 11 Drawing Sheets

U.S. PATENT DOCUMENTS

| | | | | |
|---|---|---|---|---|
| 4,288,278 | A * | 9/1981 | Akao | 156/474 |
| 4,427,145 | A * | 1/1984 | Harris | 225/97 |
| 4,439,175 | A * | 3/1984 | Cimochowski et al. | 493/413 |
| 4,948,445 | A | 8/1990 | Hees | |
| 5,200,013 | A | 4/1993 | Traber | 156/210 |
| 5,750,235 | A | 5/1998 | Yoshimasa | |
| 5,966,905 | A * | 10/1999 | O'Connor et al. | 53/429 |
| 6,254,523 | B1 | 7/2001 | Yamamoto et al. | |

FOREIGN PATENT DOCUMENTS

| | | |
|---|---|---|
| EP | 0 760 280 | 3/1997 |
| JP | 7-277369 | 10/1995 |
| JP | 8-34477 | 2/1996 |
| JP | 9-286064 | 11/1997 |
| JP | 10-305874 | 11/1998 |
| JP | 2000-128249 | 5/2000 |
| WO | WO 9739884 A1 | 10/1997 |

OTHER PUBLICATIONS

Oizumi et al., JP 07277369A, Oct. 24, 1995, (Japanese & Derwent abstracts; and Japanese machine translation).

Murata et al., JP 10305874A, Nov. 17, 1998, (Japanese & Derwent abstracts; and Japanese machine translation).

* cited by examiner

CUSHIONING MATERIAL FOR PACKAGING AND METHOD AND DEVICE FOR MANUFACTURING THE CUSHIONING MATERIAL

This application is a divisional of application Ser. No. 09/926,823, filed Dec. 26, 2001, which is now abandoned.

FIELD OF THE INVENTION

The present invention relates to a cushioning material for packaging and a method and a device for manufacturing it, particularly to a recyclable cushioning material for packaging made of a corrugated fiberboard that is used for protecting a distributed article from an impact, and a method and a device for manufacturing it.

BACKGROUND OF THE INVENTION

When an article such as a precision machine that is apt to damage due to an impact applied from the external part is distributed, the precision machine is stored in a corrugated fiberboard case, and a cushioning material made of styrene foam resin is disposed between the precision machine and the corrugated fiberboard case. Even when the impact is applied from the external part, the cushioning material made of styrene foam resin absorbs this impact, so that the impact is not directly transferred to the precision machine and therefore the precision machine is protected from the impact.

The cushioning material made of styrene foam resin has high shock absorbing ability, but a die for foam molding corresponding to the shape of each cushioning material must be prepared. The die therefore increases a molding cost. The cushioning material made of styrene foam resin is bulky. Additionally, when the cushioning material is abolished and burned out, the cushioning material may produce black smoke to make the environment worse or radiate high heat to damage a furnace.

A cushioning material made of a corrugated fiberboard is therefore conventionally suggested. A cylinder body is assembled with a corrugated fiberboard punched in a predetermined shape, and its joint is locked with a metallic wire. A feather core or a pad punched from the similar corrugated fiberboard is installed in this cylinder body assembled with the corrugated fiberboard, thereby assembling a cushioning material having a predetermined cushioning material effect.

Such conventional cushioning material made of a corrugated fiberboard requires a plurality of members punched from the corrugated fiberboard, and is formed in combination of them. The cushioning material therefore disadvantageously has a complex structure, must be manually assembled because of difficulty of automatic assembling, and hence requires higher processing cost. Since the joint of the outer cylindrical body is locked with a copper wire, this wire must be removed for recycling the cushioning material and the cushioning material is unsuitable for recycle.

Additionally, a cushioning material formed by folding a blank is conventionally known. However, the manufacturing method requires not only one step of folding the blank but also a plurality of steps of folding it from two or more directions, and thus the folding and assembling steps are complex. Therefore, the manufacturing device also must be more complex and larger.

It is an object of the present invention to provide a recyclable cushioning material for packaging which can be formed with one sheet of corrugated fiberboard without using a plurality of individual members, assembled only by the folding step at a single station, and easily and rapidly manufactured by a simple manufacturing step with a simple manufacturing device, and does not require metal or the like at all. It is another object of the present invention to provide a method and a device for manufacturing the cushioning material.

DISCLOSURE OF THE INVENTION

A cushioning material for packaging of the present invention comprises a blank obtained by forming, in one corrugated fiberboard sheet, a plurality of substantially parallel folding lines for partitioning the corrugated fiberboard sheet into a plurality of unit corrugated fiberboard and openings as article receiving parts. The plurality of unit corrugated fiberboard inter-coupled through the folding lines are alternately oppositely folded, laminated, and joined with each other to provide a corrugated fiberboard laminated structure. The openings are formed in part of the plurality of unit corrugated fiberboard to provide receiving parts. The receiving parts receive an article.

The folding lines can employ various shapes, but are preferably formed by cutting the sheet of corrugated fiberboard intermittently remaining connecting parts. Each connecting part is formed so that a pair of short notches is formed orthogonally to a cutting line, and the cutting line is divided in a region between these notches, thereby further facilitating the folding even when the corrugated fiberboard is thick. The folding lines are formed orthogonally to the corrugation direction of the corrugated fiberboard, and the receiving parts are formed so as to support the article in the corrugation direction. Thus, rigidity in the article support direction can be increased advantageously. The plurality of unit corrugated fiberboard is inter-joined using paste, thereby requiring no metal such as a wire and improving recycling suitability. A receiving plate disposed in the opening in the unit corrugated fiberboard that corresponds to the surface of the cushioning material during the assembling is connected to the end of the opening, and the receiving plate is folded to cover the end of the opening. An article receiving surface thus becomes flat advantageously.

The manufacturing method of the cushioning material for packaging of the present invention comprises the following steps:

a blank forming step of forming a plurality of parallel folding lines for partitioning the sheet of corrugated fiberboard into unit corrugated fiberboard and openings as article receiving parts;

a zigzag folding step of folding the blank alternately oppositely along the folding lines;

a pasting step of pasting the joint surfaces of the unit corrugated fiberboard inter-coupled in a zigzag shape; and a laminating step of pressing and inter-joining the pasted unit corrugated fiberboard to form a laminated body.

In the zigzag folding step, the blank is pressed relatively from both sides using a crest folding plate body and a trough folding plate body. Here, the crest folding plate body comprises a plurality of folding plates disposed on one side of a conveying route of the blank, and the trough folding plate body comprises a plurality of folding plates disposed on the other side of the conveying route of the blank. The blank can be thus simultaneously folded in the zigzag shape along the plurality of parallel folding lines for partitioning the sheet of corrugated fiberboard. Another zigzag folding step can be employed in which the blank is folded one by one using a crest folding plate and a trough folding plate. Here, the crest folding plate feeds the blanks with a conveyer and simultaneously moves vertically and horizontally, and the trough folding plate presses the folding lines to be trough-folded and simultaneously moves horizontally. The later method can rapidly respond to dimension change or the like of the cushioning material for packaging.

In the pasting step, preferably, pasting nozzles are disposed on both sides of the conveying route of the blank folded in the zigzag shape, and the pasting nozzles paste the joint surfaces of the unit corrugated fiberboard inter-coupled in the zigzag shape. The pasting step may be performed not only after the zigzag folding step but also before it.

When the relation between the crest folding and the trough folding at the folding lines of the blank is reversed in the zigzag folding step, mutually bilaterally symmetric cushioning materials for packaging having an opposite receiving part can be provided by the same device.

The manufacturing device of the cushioning material for packaging of the present invention manufactures a cushioning material for packaging from a sheet of corrugated fiberboard made blank comprising a plurality of parallel folding lines for partitioning a sheet of corrugated fiberboard into unit corrugated fiberboard and openings as article receiving parts. The manufacturing device comprises the following elements:

a zigzag folding means comprising a crest folding plate and a trough folding plate that fold the unit corrugated fiberboard at the folding lines in the zigzag shape, and are disposed engagably with the folding lines for blank surfaces on both sides of the moving route of the blank;

a pasting means disposed on both sides of the conveying route of the blank for pasting the joint surfaces of the blank; and a laminated body forming means for pressing and interjoining the pasted unit corrugated fiberboard to form a laminated body.

The zigzag folding means is capable of simultaneously holding the plurality of parallel folding lines, by forming a pair of folding plate bodies having a zigzag folding device. The folding plate bodies have the plurality of interval-adjustably folding for folding the unit corrugated fiberboard in the zigzag shape. The zigzag folding devices are disposed movably vertically to the blank surfaces on both sides of the moving route of the blank. The folding plates are structured so that they are automatically displaced by a motor in the narrowing direction of an interval between the folding plates in response to the progress of the zigzag folding. Thus, the folding plates can perform smooth zigzag folding.

Another zigzag folding means can be employed which comprises a pusher conveyer for feeding the blank orthogonally to the folding lines, a driving mechanism of the crest folding plate that is disposed under the pusher conveyer and moves the crest folding plate reciprocatingly in the blank feeding direction and vertically, a driving mechanism of the trough folding plate that is disposed over the pusher conveyer and reciprocates in the blank feeding direction, and a pressing mechanism. The driving mechanism of the crest folding plate, the driving mechanism of the trough folding plate, and the pressing mechanism are integrally controlled in response to control amount of the pusher conveyer, thereby facilitating the control and response to a model change. Preferably, the cushioning material manufacturing device has a laminated body molding means that presses, with a molding plate, the surface rectangular to the laminating direction of the laminated body formed by the laminated body forming means to uniform the height of the laminated body.

DETAILED DESCRIPTION OF THE PREFERRED EMBODIMENTS

Figure 1:
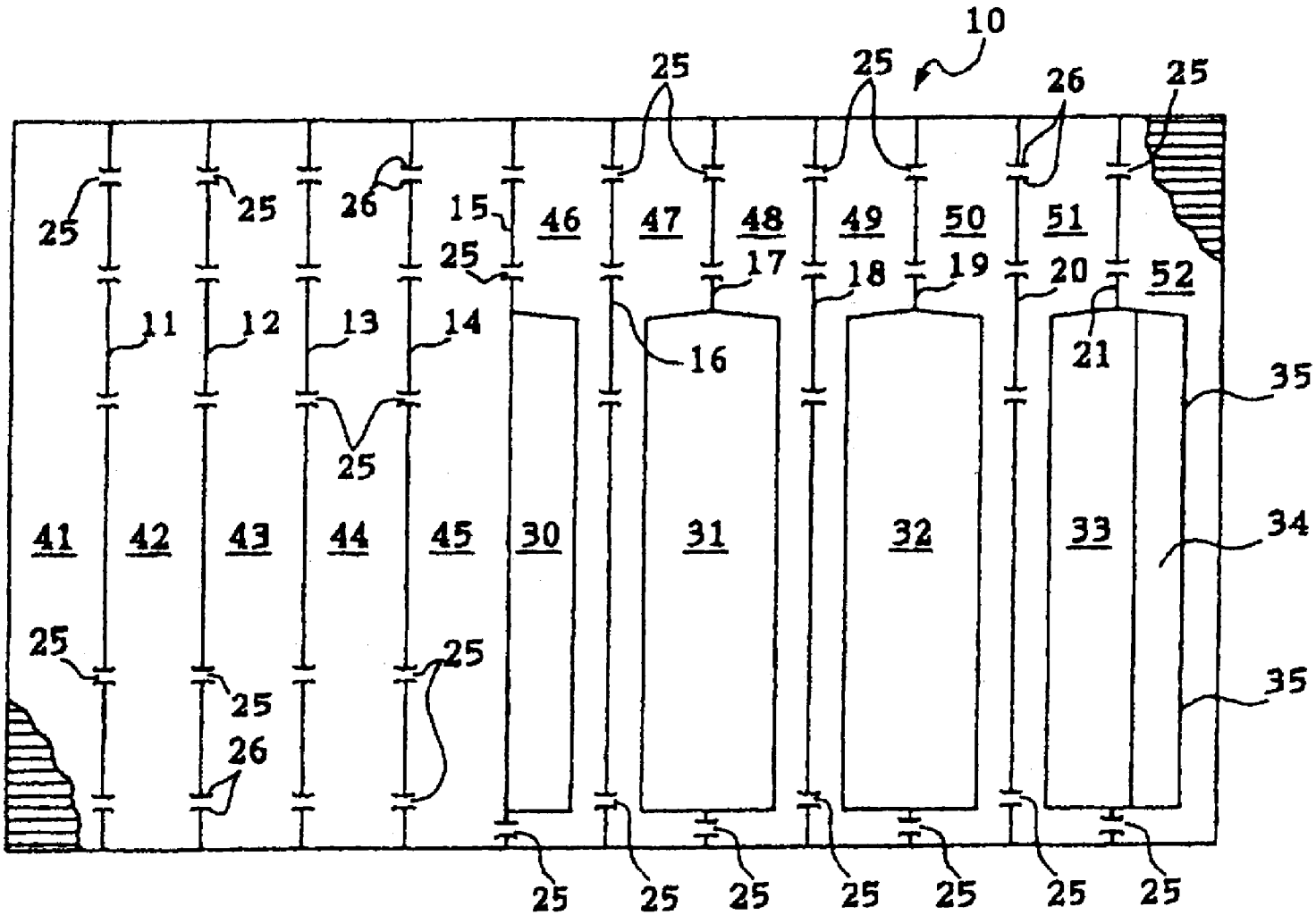
FIG. 1 is an expansion plan view (a plan view of a blank) of a cushioning material for packaging in accordance with an exemplary embodiment of the present invention.
Figure 2:
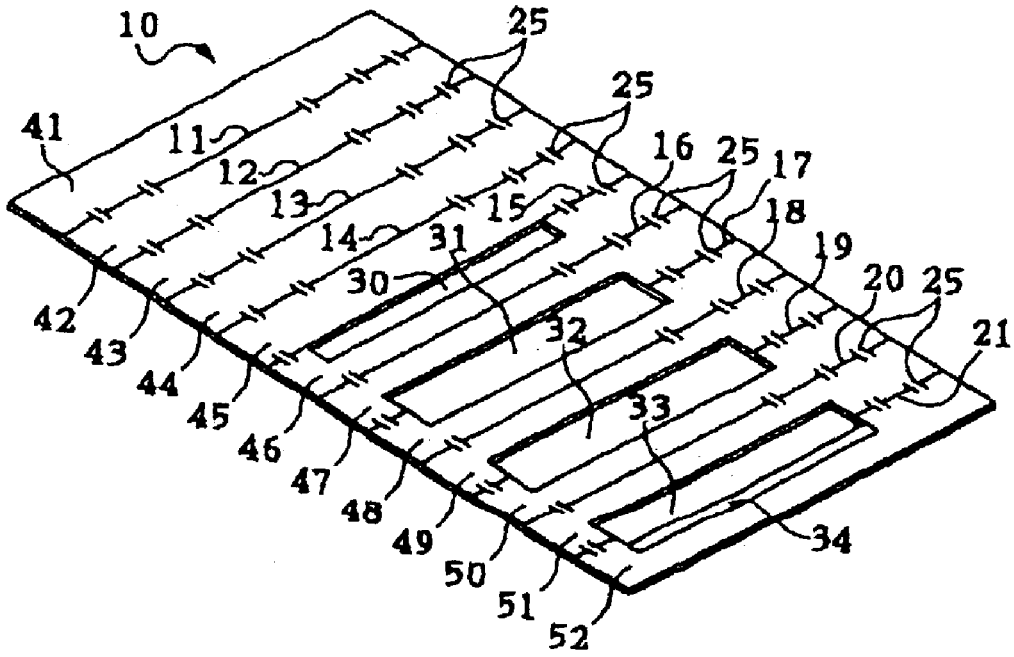
FIG. 2 is an expansion perspective view of the cushioning material.

Referring to FIG. 1 and FIG. 2, there is shown a blank 10 comprising a sheet of corrugated fiberboard used for assembling a cushioning material in accordance with the embodiment of the present invention.

In this blank 10, 11 cutting lines 11, 12, 13, 14, 15, 16, 17, 18, 19, 20, 21 as folding lines are formed in substantially parallel in the direction rectangular to the corrugation direction of the corrugated fiberboard. These cutting lines 11 through 21 partition the blank 10 into 12 unit corrugated fiberboard 41, 42, 43, 44, 45, 46, 47, 48, 49, 50, 51, 52.

Each of the cutting lines 11 through 14 includes five connecting parts 25 intermittently. Each of the cutting lines 15, 17, 19, 21 includes three connecting parts 25. Each of the cutting lines 16, 18, 20 includes four connecting parts 25. Each of these connecting parts 25 is formed, by forming a pair of short notches 26 orthogonally to the cutting lines 11 through 21 so that each of the cutting lines 11 through 21 is divided in a region between the notches 26. The connecting parts 25 therefore connect the unit corrugated fiberboard 41 through 52 mutually foldably in the extending direction of the corrugation of the blank 10.

The unit corrugated fiberboard plate 46 has an opening 30. One side of the opening 30 corresponds to the cutting line 15. The unit corrugated fiberboard 47, 48 have a shared opening 31. The unit corrugated fiberboard 49, 50 have a shared opening 32. The unit corrugated fiberboard 51, 52 have a shared opening 33. A receiving plate 34 projecting into the opening 33 is formed. This receiving plate 34 is connected to the unit corrugated fiberboard plate 52 through eight intermittent connecting parts 35.

An operation of assembling a cushioning material 57 with the blank 10 will be described hereinafter.

The flat blank 10 shown in FIG. 2 is folded at the cutting lines 11 through 21 alternately by crest folding and trough folding. In other words, the crest folding is performed at the cutting lines 11, 13, 15, 17, 19, 21 of the blank 10, and the trough folding is performed at the cutting lines 12, 14, 16, 18, 20. These cutting lines 11 through 21 partition the unit corrugated fiberboard 41 through 52 into each other, however the blank 10 does not fall to pieces because each of the cutting lines 11 through 21 has a plurality of connecting parts 25. The blank 10 is folded while the unit corrugated fiberboard 41 through 52 are inter-coupled at the connecting parts 25.

Figure 3:
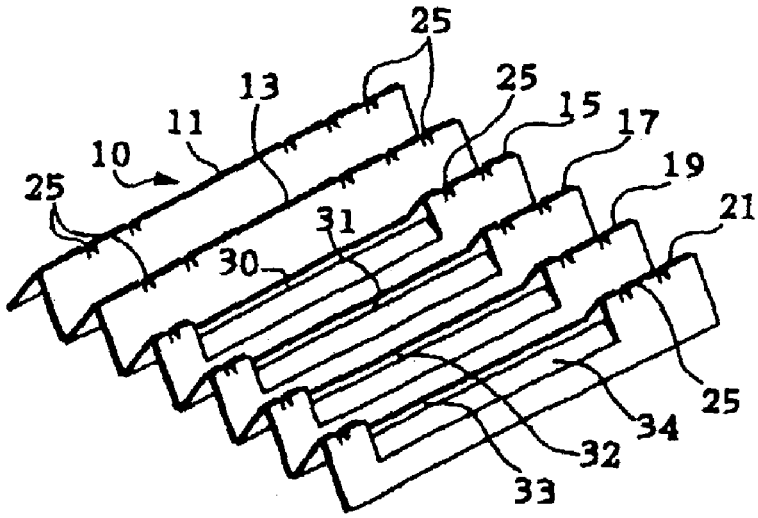
FIG. 3 is a perspective view of the blank alternately folded at cutting lines.

Before the folding of the blank 10, an adhesion means such as glue paste is applied to each of the joint surfaces of the unit corrugated fiberboard 41 through 52 to be inter-joined. The blank 10 is folded as shown in FIG. 3 after the application, ad the folded unit corrugated fiberboard 41 through 52 are bonded together by pressure to provide a state shown in FIG. 4. The unit corrugated fiberboard 41 through 52 forms a substantially square pole shape in the joint state.

Figure 5:
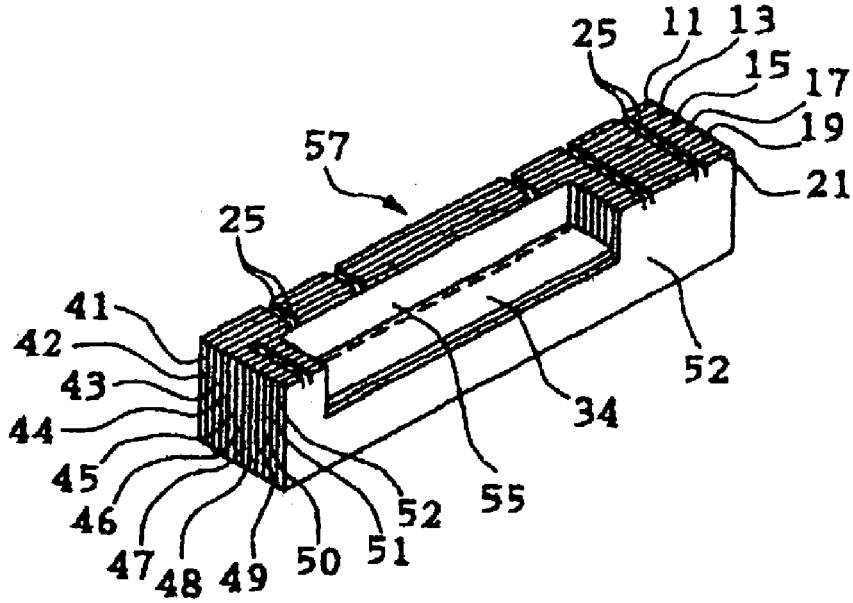
FIG. 5 is a perspective view of the cushioning material in state in which a receiving plate is folded inside.
Figure 6:
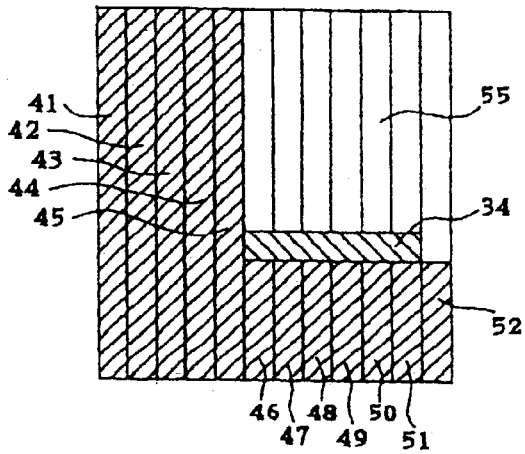
FIG. 6 is a longitudinal sectional view of a part having a receiving part.

The openings 30, 31, 32, 33 previously formed in the blank 10 form a recessed part 55 functioning as a receiving part. The receiving plate 34 is folded into the recessed part 55 at the intermittent connecting parts 35, as shown in FIG. 5 and FIG. 6, so as to cover the upper ends of the unit corrugated fiberboard 46, 47, 48, 49, 50, 51, 52 in the recessed part 55. At this time, also, glue paste has been previously applied to the inside surface of the receiving plate 34, and the receiving plate 34 is adhered to the upper ends via he glue paste.

The cushioning material 57 is assembled by the operation discussed above as shown in FIG. 5 through FIG. 7. The recessed part 55 of the cushioning material 57 has a lower surface comprising the receiving plate 34, and the upper surface of he receiving plate 34 receives a bottom surface of a corner of an article. The unit corrugated fiberboard 46 through 52 are upright under the receiving plate 34 for receiving the bottom surface, so that seven upright unit corrugated fiberboard 46 through 52 receive the load of the corner of the article. Additionally, the unit corrugated fiberboard 46 through 51 are upright in the corrugation direction of the corrugated fiberboard, so that the article is supported using the wale of the corrugation of the blank 10. This structure has a larger strength.

Figure 7:
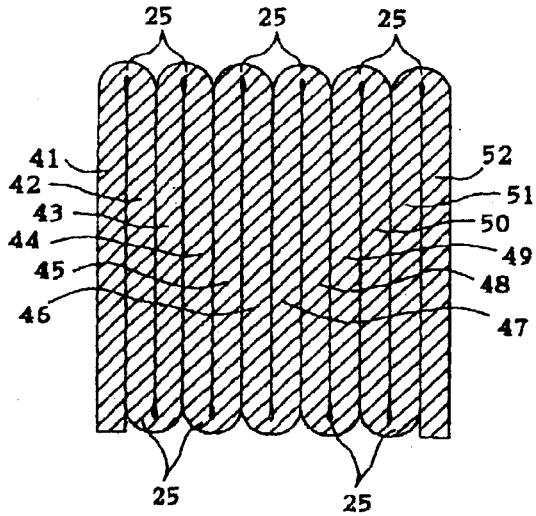
FIG. 7 is a longitudinal sectional view of a part having a connecting part.

FIG. 7 shows parts of the unit corrugated fiberboard 41 through 52 having the connecting parts 25. The unit corrugated fiberboard 41 through 52 are inter-coupled at their ends through the connecting parts 25. In other words, using the connecting parts 25 previously formed in the blank 10 including the unit corrugated fiberboard 41 through 52, the fiberboard 41 through 52 can be inter-coupled. One cut blank 10 is folded along the cutting lines 11 through 21 alternately by crest folding and trough folding to assemble the cushioning material 57. As a result, a single blank 10 forms the cushioning material 57.

Figure 8:
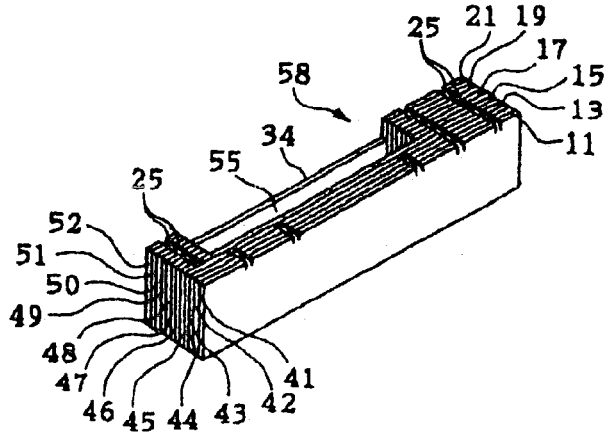
FIG. 8 is an assembled perspective view of the symmetric cushioning material.

The cushioning material formed with such blank 10 has a feature that a cushioning material 58 symmetry with the cushioning material 57 can be assembled using a blank 10 with the same structure as shown in FIG. 8. The cutting lines 11 through 21 of the blank 10 are folded simply oppositely between the crest folding and the trough folding, thereby forming the cushioning material 58 shown in FIG. 8.

Speaking in detail, the blank 10 is folded by crest-folding the cutting lines 12, 14, 16, 18, 20 and trough-folding the cutting lines 11, 13, 15, 17, 19, 21, and 12 unit corrugated fiberboard 41 through 52 are inter-joined. A cushioning material 58 obtained in this method is reversed upside down to provide a cushioning material 58 shown in FIG. 8. This cushioning material 58 is symmetric with the cushioning material shown in FIG. 4 and FIG. 5. A part of the article received by the cushioning material 58 is on the opposite side of the part received by the cushioning material 57 shown in FIG. 4 and FIG. 5.

Figure 9:
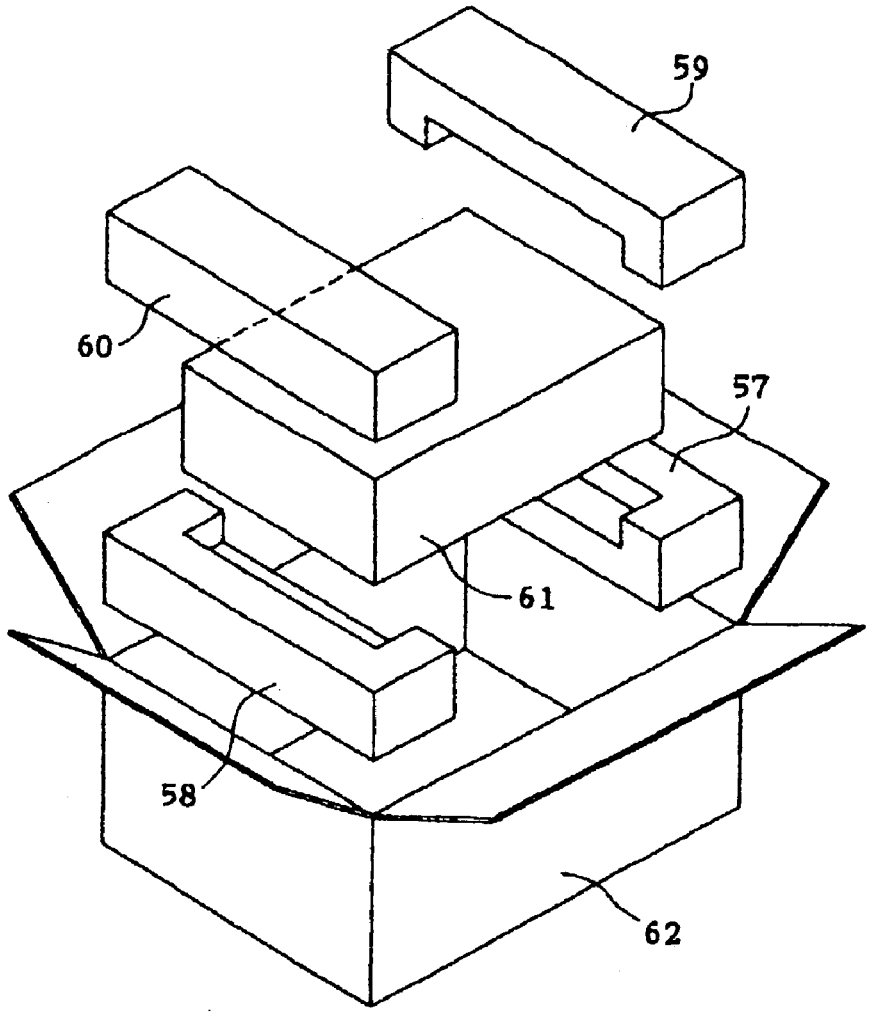
FIG. 9 is an exploded perspective view of a packaging state of an article using the cushioning material.
Figure 10:
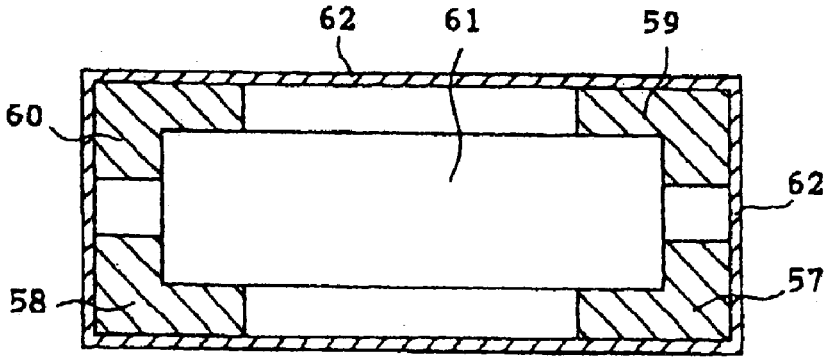
FIG. 10 is a longitudinal sectional view of a corrugated fiberboard case after packaging.

For storing an article such as a precision machine 61 in a corrugated fiberboard case 62, four cushioning materials 57, 58, 59, 60 as shown in FIG. 9 and FIG. 10 are employed. The cushioning material 57 has the shape shown in FIG. 4 and FIG. 5. The cushioning material 58 has the shape shown in FIG. 8. The upper cushioning materials 59, 60 with a similar structure are also prepared.

The precision machine 61 is stored in the corrugated fiberboard case 62 as shown in FIG. 10. In other words, the cushioning material 57, 58 receive corner parts of two facing edges on the lower part of the precision machine 61, respectively, and the upper cushioning materials 59, 60 receive corner parts of two facing edges of the precision machine 61, respectively. The precision machine 61 is packed by closing the lid of the corrugated fiberboard case 62, and then distributed.

In this packing, an external impact is absorbed by cushioning materials 57 through 60 made of the corrugated fiberboard interposed between the precision machine 61 and the corrugated fiberboard case 62, and therefore is not transferred to the precision machine 61. The precision machine 61 is therefore prevented from damaging during distribution.

Figure 11:
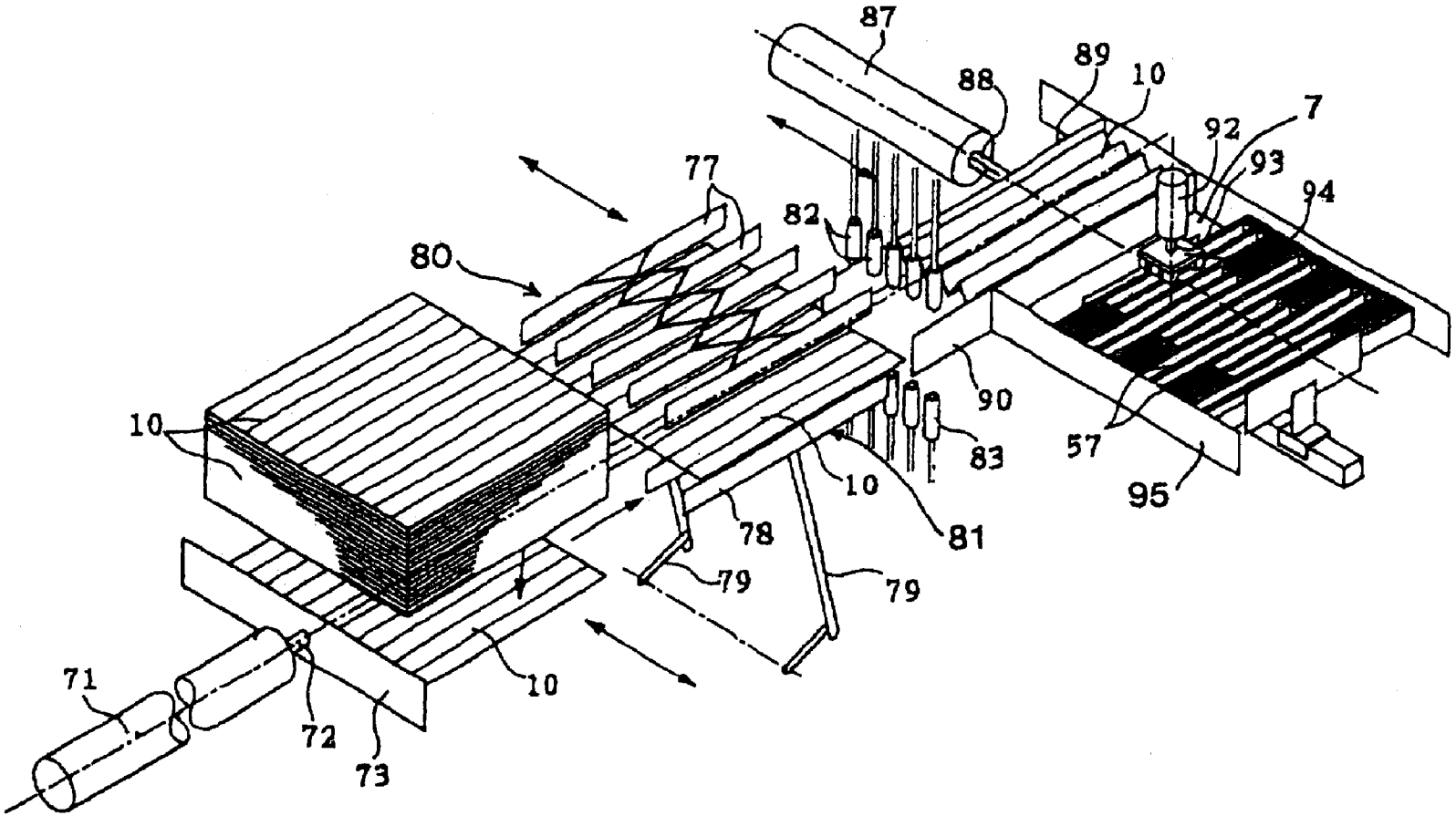
FIG. 11 is a schematic perspective view of a device for assembling the cushioning material.

Referring now to FIG. 11 there is schematically shown a cushioning material manufacturing device for assembling the cushioning materials 57, 58 from the blank 10.

The cushioning material manufacturing device of the present invention comprises a blank supply means, a zigzag folding means, a pasting means, a laminated body forming means, and a laminated body molding means.

The blank supply means has a cylinder 71, and a pressing plate 73 is mounted to a piston rod 72 of the cylinder 71. The pressing plate 73 presses the lowest blank 10 of a plurality of piled blanks 10 forward with an operation of the cylinder 71.

The blank 10 pressed by the cylinder 71 is fed to a zigzag folding means having a pair of trough folding plate body 80 and crest folding plate body 81, and inserted between the trough and crest folding plate bodies. The trough folding plate body 80 and the crest folding plate body 81 comprise a plurality of interval-adjustable folding plates 77, 78 positioned over and under a blank moving route, respectively. When the folding plate body 81 positioned on the downside is raised by links 79, and hence folding plates 78 are raised to press up the crest folding lines, the folding plates 77 positioned on the upside inevitably press down the trough folding lines. When both folding plates further displace telescopically, the cutting lines 11 through 21 of the blank 10 are folded as shown in FIG. 3.

For simultaneously folding all unit corrugated fiberboard along the folding lines of the blank, the folding plates 77 and/or the folding plates 78 must be vertically moved and simultaneously respective intervals between the folding plates 77 and between the folding plates 78 must be narrowed. In the present embodiment, only the folding plates 78 are vertically moved. A specific mechanism of the trough folding plate body positioned on the upside will be hereinafter described in FIG. 12 and FIG. 13.

Figure 12:
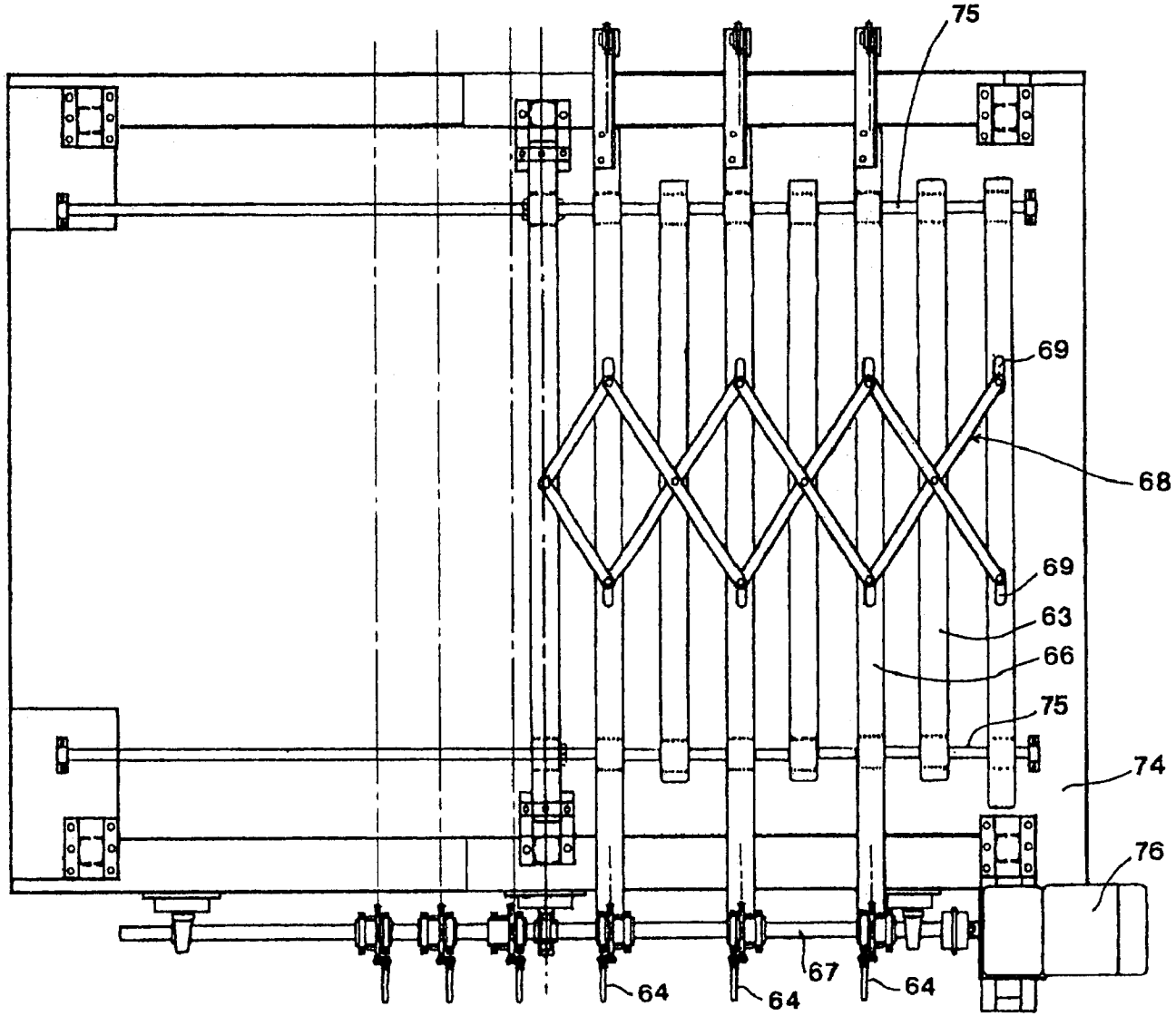
FIG. 12 is a schematic plan view of a zigzag folding means.
Figure 13:
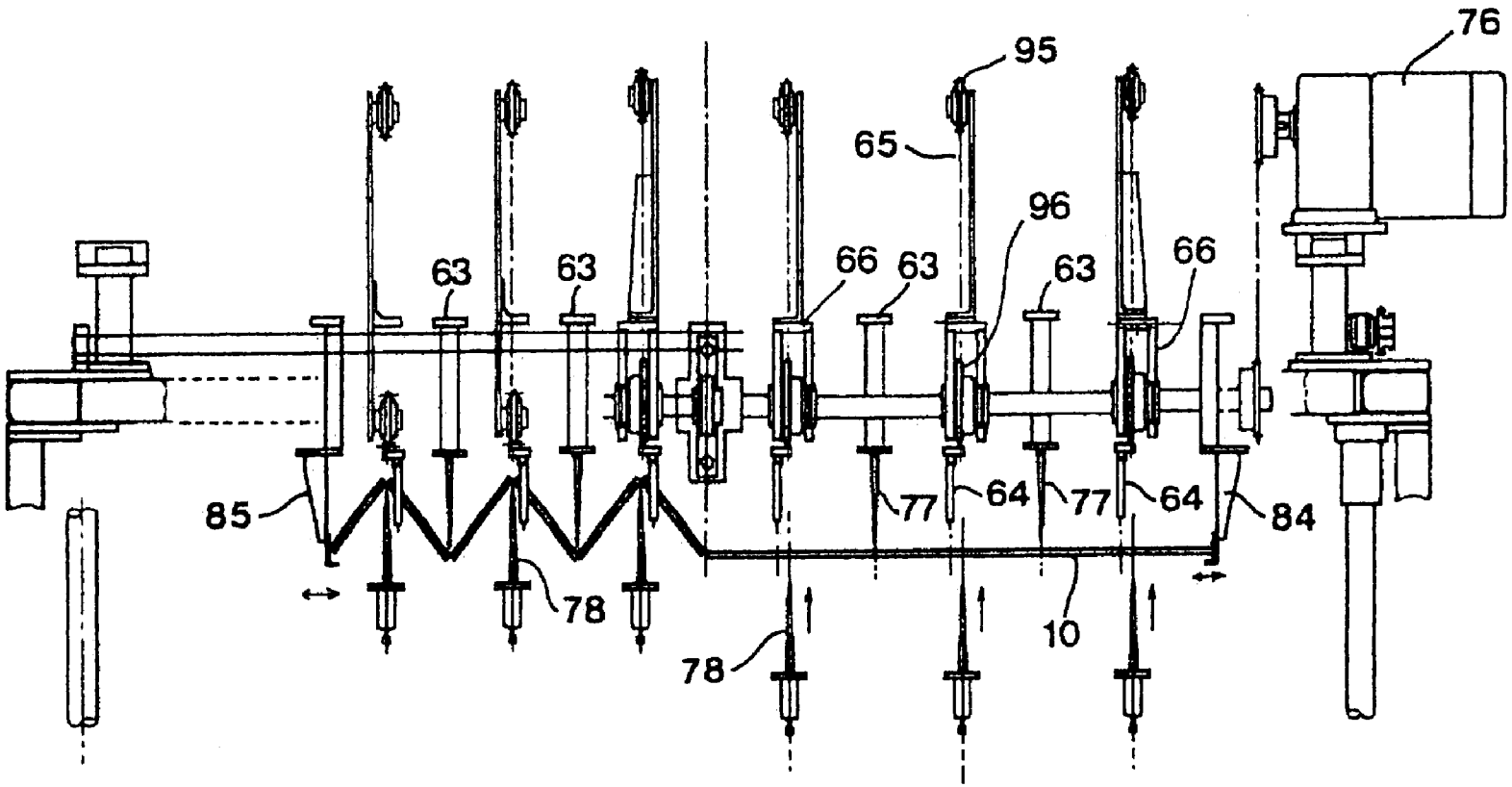
FIG. 13 is a schematic side view of the zigzag folding means.

FIG. 12 and FIG. 13 schematically show a state just before the start of the zigzag folding of the right half and a state after the completion of the zigzag folding of the left half, respectively.

The trough folding plate body 80 in the present embodiment alternately comprises folding-plate fixing beams 63 having a folding plate 77 and pusher mounting beams 66. The pusher mounting beams 66 endlessly and rotatably support, using a chain 65, pushers 64 for feeding the zigzag folded blank to the next process. Each folding-plate fixing beam 63 has a pair of guide holes and is slidably engaged with a pair of guide rods 75, 75 born by a frame 74. Each pusher mounting beam 66 has a pair of guide holes and is slidably engaged with the pair of guide rods 75, 75. One end projecting sideward of the pusher mounting beams 66 has a screw hole, and is screwed with a screw bar 67 rotated by a servomotor 76.

The manufacturing device of the present embodiment in FIG. 12 has three folding plates on the right side of the central part and three folding plates on the left side. The screw bar 67 has screws opposite between the right and left sides and the screws have smaller pitch with approaching the central part so that the folding plates come to the central part with the progress of the folding.

The folding-plate fixing beams 63 and the pusher mounting beams 66 are inter-coupled through a telescopic link mechanism 68 as shown in FIG. 12. Each pusher mounting beam 66 has a pair of slide grooves 69, pair shafts at both ends of a link of the telescopic link mechanism 68 are engaged with the slide grooves to provide a slider. A crossing part disposed in the intermediate part of the link is rotatably mounted to each folding-plate fixing beam 63. A beam disposed in the center of the device of barns of the telescopic link mechanism is fixed to the frame. Therefore, when the screw bar 67 rotates with the progress of the folding, the pusher mounting beams 66 move in accordance with the screw pitch, the folding-plate fixing beams also shift toward he center, and the interval between the beams become narrower.

Blank support members 84, 85 in FIG. 12 and FIG. 13 support both ends parallel with the folding lines of the blank and shift to the center with the rotation of the screw bar 67 with the progress of the zigzag folding. The bases of the blank support members are screwed with the screw bar. A servomotor 76 rotates the screw bar 67. Chain sprockets 95, 96 drive and guide a chain having the pushers 64 endlessly. The pushers rotate by rotation of the chain sprockets to press the zigzag folded blank to a next process.

The crest folding plate body that is disposed on the downside has a structure similar to that of the trough folding plate body disposed on the upside. The difference between them is simply a fact that pitch of the crest folding plates shifts by a half pitch from the trough folding plates and the assembly moves upward to hit the folding lines of the folding plates to be folded. Detailed description of the crest folding plate body is eliminated.

In a zigzag folding operation, the interval between the tips of the trough folding plates 77 match the interval between the through folding lines until the tips of the trough folding plates 77 come into contact with the folding lines of the blank, and the crest folding plates 78 are maintained at the interval between the crest folding lines. When the crest folding plate body 81 rises with an operation of the links 79, the crest folding plates 78 hit the folding lines at the crest folding positions, the folding lines at the trough folding positions hit the trough folding plates, and the folding is started. The motor 76 rotates the screw bar 67 synchronously with the operation. The folding plates spaced from the center having a longer moving distance displace largely with the progress of the folding, and the folded blank is positioned in the center of the conveying direction at the completion of the folding.

Change of the size or the like of the manufactured cushioning material is allowed by adjusting the screw positions of the pusher mounting beams with the screw bars. For providing a cushioning material for packaging bilaterally symmetric with the cushioning material discussed above, which has an opposite receiving part and a reverse relation between the crest folding and the trough folding, set positions of the blank support members are mutually shifted right or left by the distance between the folding lines. Thus, the crest folding places and the trough folding places are reversed, and the latter cushioning material for packaging can be easily manufactured by the same device. Instead of the method discussed above, a blank can be simply supplied inside out to the zigzag folding means to provide the latter cushioning material.

After the zigzag folding of the blank, the upper and lower folding plates 77, 78 are opened, the folded blank is pressed by the pusher 64 further forwardly and passed through a position having the pasting means. The pasting means, as shown in FIG. 11, comprises a pair of pasting nozzle groups 82, 83 that are arranged directed to the passing positions of the folds on the upper and lower sides of the conveying route of the zigzag folded blank.

When the blank passes through the position, the pair of pasting nozzle groups 82, 83 supply glue paste to coat the joint surfaces of the unit corrugated fiberboard 41 through 52 with the glue paste. The blank 10 coated with the glue paste is fed to the front side of a pressing plate 89 of a piston rod 88 of a cylinder 87. The cylinder 87 is disposed rectangularly to the blank feeding direction by the cylinder 71, has the pressing plate 89 at the tip of the piston rod 88, and forms a laminated body forming means together with a shutter 90 disposed forward of the moving direction.

Figure 4:
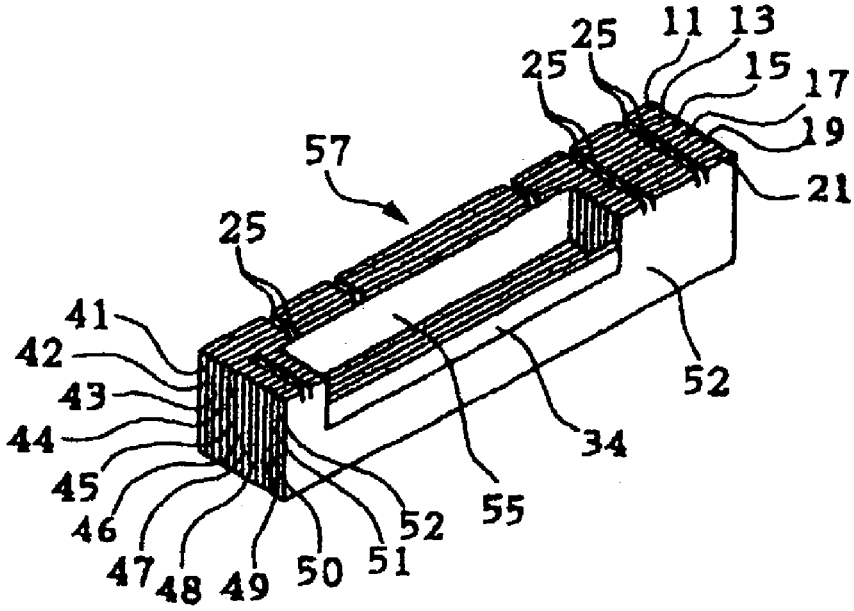
FIG. 4 is a perspective view of the cushioning material in a state in which unit corrugated fiberboard is joined with each other.

When the folded blank reaches the front side of the pressing plate 89, the cylinder 87 operates to press the piston rod 88. At this time, the blank 10 folded as shown in FIG. 3 is folded and pressed against the shutter 90 by the pressing plate 89. The unit corrugated fiberboard 41 through 52 of the blank 10 are thus inter-joined as shown in FIG. 4 to form a cushioning material comprising a corrugated fiberboard laminated body.

The shutter 90 is then opened and the cushioning material is pressed out to a cushioning material receiving shelf 95. The cushioning material receiving shelf 95 has a laminated body molding means over it. The laminated body molding means comprises a pressing cylinder 92 for pressing and unforming the cut surface of the laminated unit corrugated fiberboard. When the cushioning material 57 is supplied to the downside of the pressing cylinder 92, the cushioning material 57 is pressed from the upside by a molding plate 94 mounted to the tip of a piston rod 93 of the pressing cylinder 92 so that recessed and projecting parts of the upper surface are eliminated, and adequately molded. Thus, the cushioning material 57 is assembled.

The cushioning material for packaging of the present embodiment is thus assembled fully automatically, by automatically folding one blank 10 cut as shown in FIG. 1 and FIG. 2 with the manufacturing device as shown in FIG. 10 and FIG. 11 and by performing the glue paste adhesion. Folding the blank 10 at he the cutting lines 11 through 21 alternately by the crest folding and the trough folding have assembled the cushioning material 57. Reversing the relation between the crest folding and the trough folding at the cutting lines 11 through 21, mutually bilaterally symmetric cushioning materials with the cushioning material 57 can be assembled. In such a structure, the cushioning materials can be assembled from a single kind of blank 10. Therefore, a single punching die is only required and the blank 10 is punched only by the punching die.

The cushioning materials 57, 58 of the present embodiment can be assembled perfectly mechanically without any manual operation, thereby allowing drastic cost reduction. The cushioning materials can be assembled with manpower of 1/10 of that required for a conventional cushioning material with a similar structure, thereby largely saving manpower.

Additionally, the corrugated fiberboard is used setting the corrugation direction to be vertical, so that higher strength than the prior art can be obtained. The strength obtained in this case is about 10 times higher than that in the case that the corrugation direction is set transverse. In the present embodiment, the blank 10 is simply folded and assembled, so that another material is not required and especially metal is not used at all. Therefore, a completely recyclable cushioning material can be obtained.

When an article is packaged for short distance transportation or short term stocking, the article is surrounded with four cushioning materials 57 through 60 without using the corrugated fiberboard case 62 shown in FIG. 9 and FIG. 10, and the surrounded article is tied with a string. Thus distribution with bare packaging is allowed. A plurality of cushioning materials can be assembled by sufficiently extending the dimension in the length direction of the cutting lines 11 through 21 as shown in FIG. 1, forming the plurality of cushioning materials together, and then cutting them at predetermined positions. Such cushioning material can be also used as a core material of a corrugated fiberboard pallet.

Figure 14:
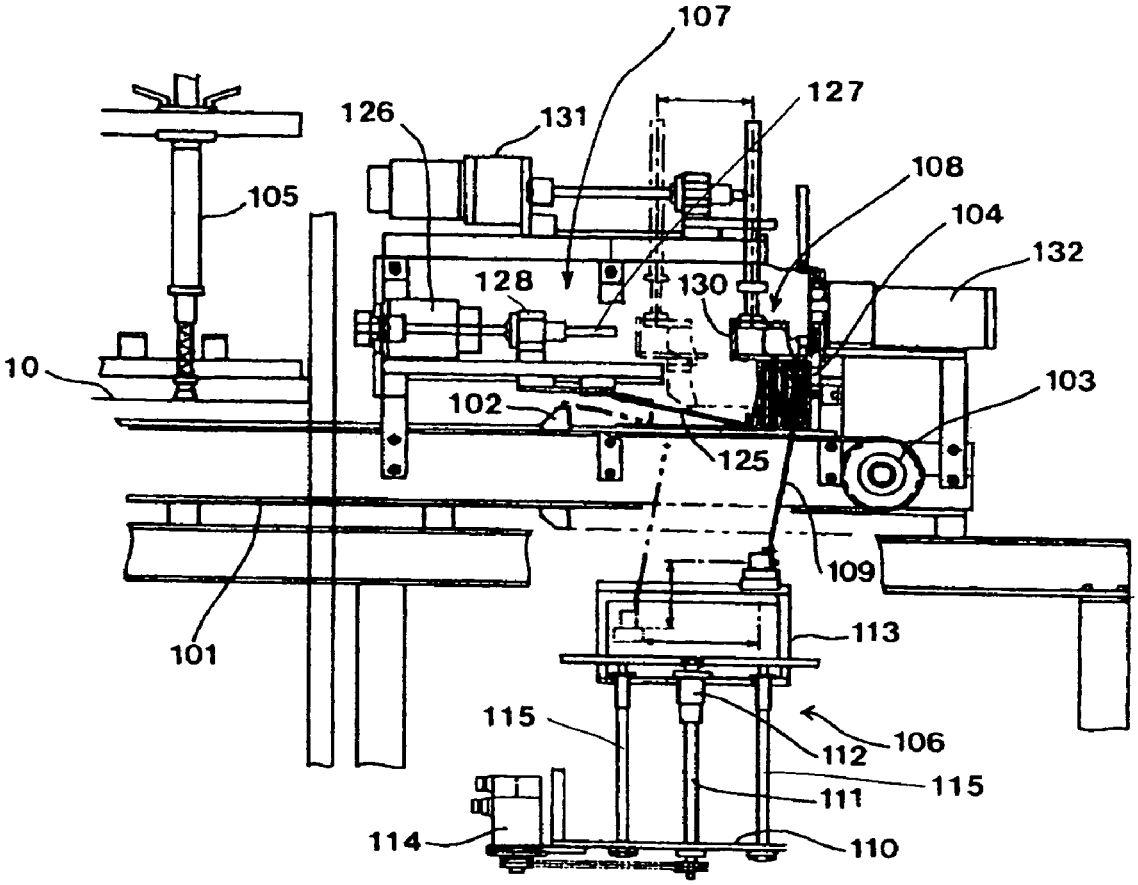
FIG. 14 is a schematic side view of a zigzag folding means in accordance with another exemplary embodiment of the present invention.
Figure 15:
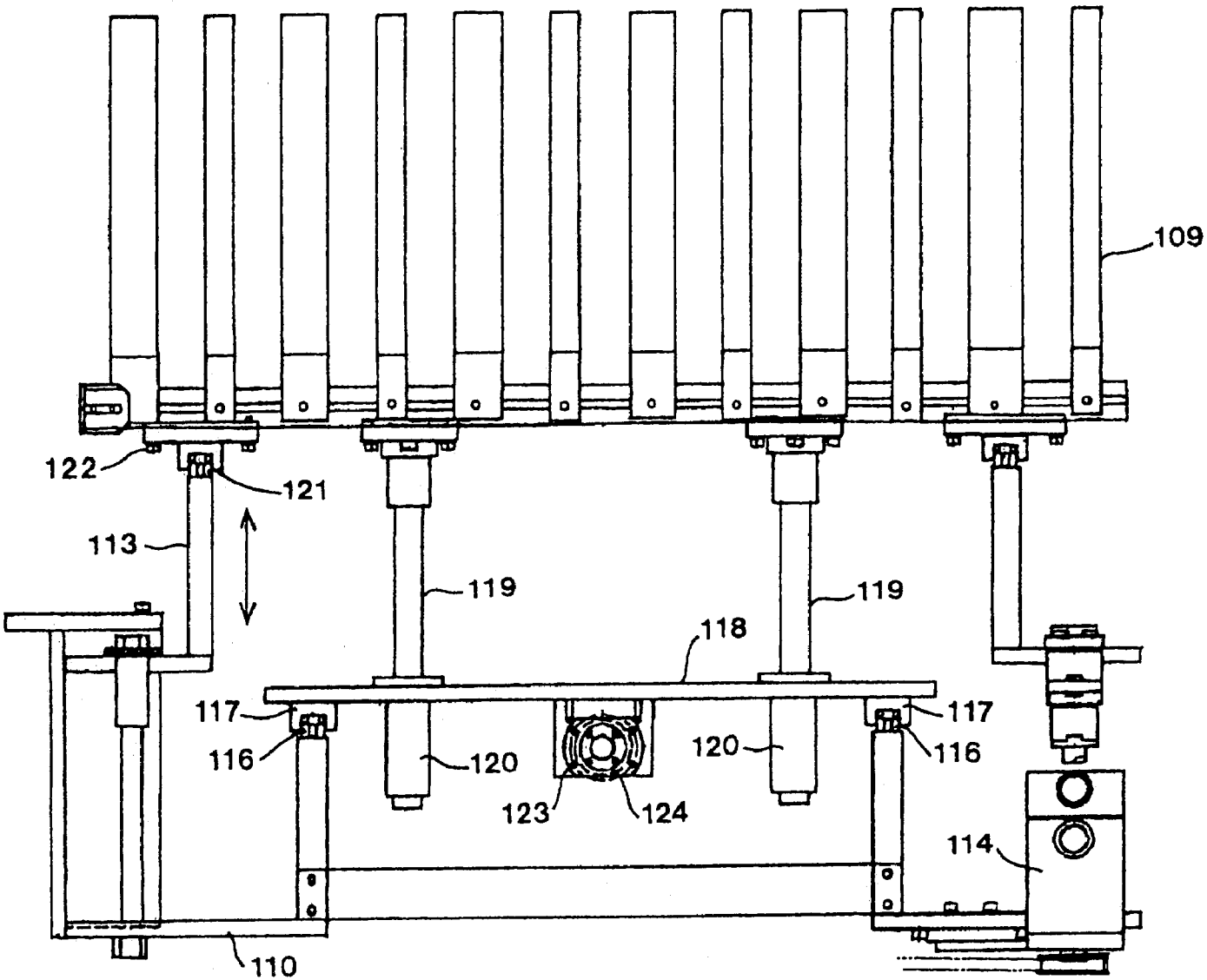
FIG. 15 is a front view of a main part of a driving mechanism of a crest folding plate of the zigzag folding means.
Figure 16:
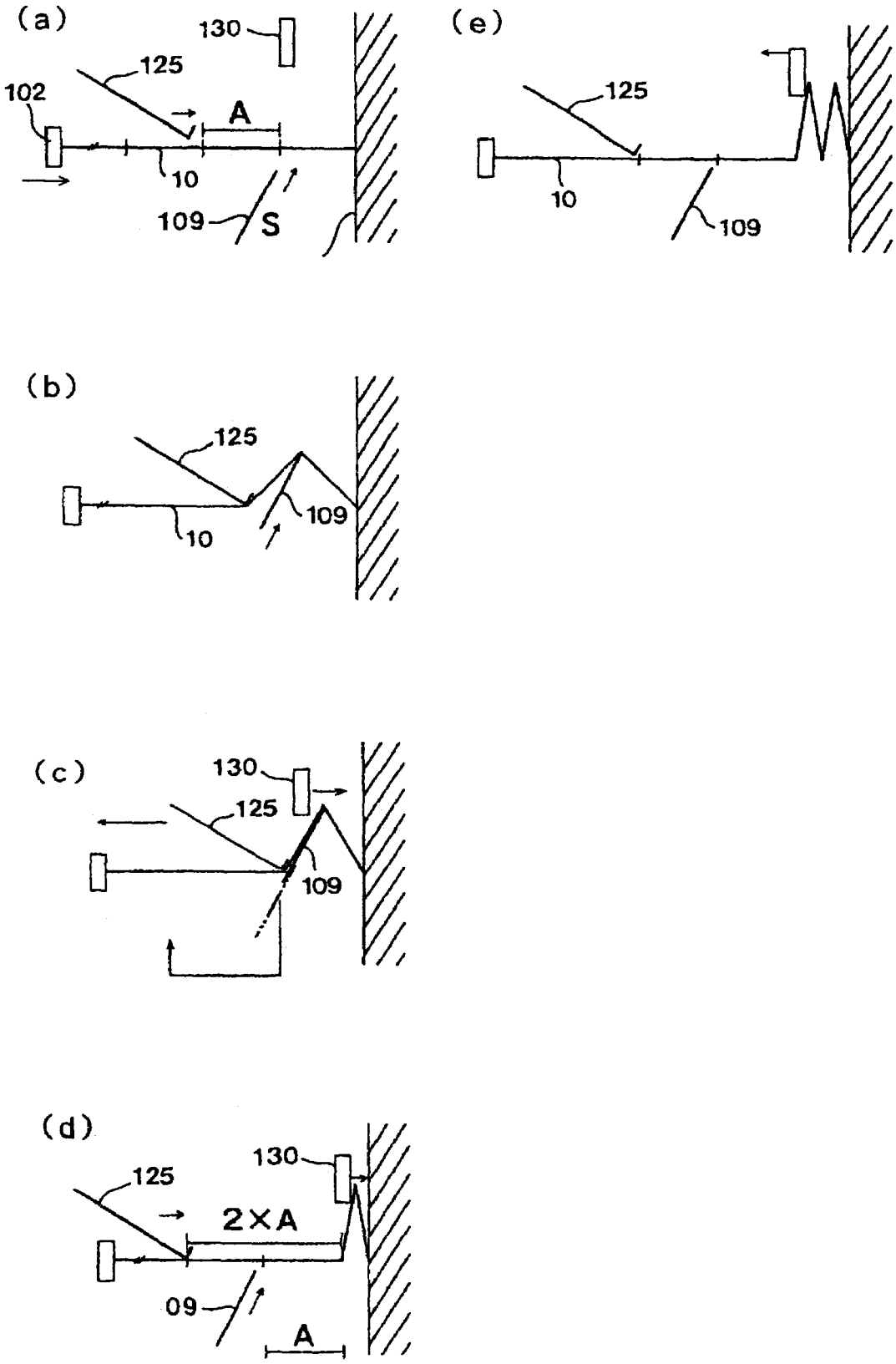
FIG. 16 is a flow chart of a zigzag folding method by the zigzag folding means.

Referring now to FIG. 14 through FIG. 16, there is shown a zigzag folding device in accordance with another embodiment in the cushioning material manufacturing device of the present invention. In this embodiment, zigzag folds are sequentially folded while the blank is fed, instead of simultaneously folding of all the folds. The zigzag folding device can be therefore formed only with a pair of upper and lower folding plates, so that the zigzag folding can be easily performed only by die change or motor control.

The zigzag folding device 100 of this embodiment mainly comprises a pusher conveyer 101 for feeding the blank 10 rectangularly to the folding lines, a crest folding plate driving mechanism 106 disposed under the pusher conveyer, a trough folding plate driving mechanism 107, and a pressing mechanism 108.

The pusher conveyer 101 comprises a plurality of narrow belts having a pusher 102 in parallel, and feeds the blank 10 to a zigzag folding position with a servomotor 103 synchronously with the progress of the folding. The blank 10 supplied from a blank stacker onto the pusher conveyer 101 with a blank supply device 105 is pressed and fed by the pusher to hit a stopper 104 disposed at the downstream end to start the zigzag folding.

The crest folding plate driving mechanism 107, as shown in FIG. 15, has crest folding plates 109 in a comb tooth shape that are formed so as to vertically move between the narrow belts of the pusher conveyer, and moves the crest folding plates vertically or laterally in the conveyer progressing direction. The crest folding plates 109 are slightly tilted in the blank feeding direction as shown in FIG. 14, so that the crest folding plates 109 easily and adequately butt on the folding lines at the crest folding positions. The crest folding plates 109 are slidably disposed on movable frames 113 to which collar members 112 are fixed. The collar members 112 are screwed with vertically driven screw bars 111 stood on a fixing frame 110. The movable frames 113 are vertically moved by a screw operation when a motor 114 rotates the screw bars 111. A guide rod 115 is used for vertically moving the movable frames disposed on the fixing frame.

The fixing frame 110 has a pair of first rails 116 for allowing the crest folding plates 109 to move in the conveyer progressing direction, and slidably supports a plate 118 having guide pieces 117 engaging with the rails. A pair of rods 119 fixed to bases of the crest folding plates is vertically movably engaged with a pair of collars 120 disposed on the plate 118. A collar 123 screwed with a screw bar, which is driven by a motor for driving the crest folding plates 109 in the conveyer progressing direction, is fixed to the plate 118. When the screw bar 124 is rotated, the plate 118 moves along the first rails 116 via the collar 123. When the plate 118 moves, rods 119 transfer the moving information to the crest folding plates 109, second guide pieces 122 move on the second rails 121, and the crest folding plates 109 can move in the blank moving direction. While, the motor 114 operates to vertically move the movable frames 113 via the screw bar 111. Thus, the crest folding plates 109 can perform a mixed motion of a vertical movement and a movement in the blank conveying direction.

Trough folding plates 125, as shown in FIG. 14, has a comb tooth shape tilting down in the blank conveying direction, and their tips are bent slightly hooklike so as to easily engage with the folding lines. The trough folding plates 125 are capable of translating in parallel along the upper part of the pusher conveyer. Their bases are fixed to a collar member 128 screwed with a screw bar 127 rotated by a motor 126, and their tips are engaged with the trough folding lines, so that the trough folding plates 125 can move with the blank.

The pressing mechanism 108 further presses, toward the stopper, the blank formed in a crest folding shape by both folding plates to certainly assist the folding and hold the folding state, and a pressing plate 130 can move vertically and laterally. In FIG. 14, a motor 131 is used for horizontal movement, and a motor 132 is used for vertical movement.

Referring now to FIG. 16, there is shown a zigzag folding method using a flow chart in the present embodiment having the structure discussed above.

The blank 10 is pressed by the pusher 102 to be fed to hit the stopper 104. At this time, the crest folding plates 109, the trough folding plates 125, and the pressing plate 130 are positioned at home positions at which they do not engage with each other. When the crest folding plates 109 rise in the present state, their tips hit the first crest folding line. In this state, the crest folding plates 109 further rise and move ahead. At this time, the tips of the trough folding plates move on the above part of the trough folding line. Therefore, when the rising of the crest folding plates 109 moves up the blank, the trough folding lines hit the trough folding plates to prevent the further rising of the crest folding plates (FIG. 16*b*). The trough folding plates also move ahead in cooperation with the forward movement of the crest folding plates in the present state, so that the crest folding line is pressed to provide good crest folding. In the crest folding state (FIG. 16*c*), the crest folding plates 109 go down and return to initial positions. At this time, the pressing plate 130 goes down to slightly falling position from the top of the crest folding part to engage with the part to prevent the fold from returning following the falling of the crest folding plates.

After the crest folding plates 109 are perfectly pulled out of the blank, the pressing plate 130 and the trough folding plates 125 further go ahead to strengthen folding until thickness between the trough folds becomes α. The pressing plate 130 then continues to press the left end of the folding part as shown in the diagram while the crest folding plates 109 return to positions engaging with the folding line of the next crest folding part. The trough folding plates 125 return to positions engaging with the third trough folding line from the right end (FIG. 16*d*). Then, the steps discussed above are repeated from the present state to provide the second crest folding, and then the crest folding plates and the trough folding plates return to provide the state shown in FIG. 16*c*. Here, steps in FIG. 16*d* and FIG. 16*e* are repeated to provide sequential zigzag folding. During the steps, the pusher of the conveyer always presses the blank, and the pusher conveyer always moves in synchronization with the movements of the crest folding plates 109, the trough folding plates 125, and the pressing plate 130. An encoder measures a rotation angle of the servomotor 103 for driving the pusher conveyer, and the pusher conveyer is controlled. Based on the control amount, the crest folding plate driving mechanism 106, the trough folding plate driving mechanism 107, and the pressing mechanism 108 are integrally controlled.

When the movements of the pusher conveyer 101, the crest folding plates 109, the trough folding plates 125, and the pressing plate 130 are previously programmed based on the movement of the pusher conveyer 101 and stored in a controller, automatic rapid zigzag folding can be performed only by specifying the program. Blanks with different size can be zigzag folded only by specifying the moving directions with the program, so that a special die change work is not required and rapid response is allowed.

After the completion of the zigzag folding, the blank is pressed vertically to the paper surface as shown in FIG. 14 and the next laminating process is started. In the manufacturing device of the present embodiment, the pasting nozzles are arranged on both sides of the passing route of the blank in the front of the zigzag folding device as shown in FIG. 11. A pasting process is finished before the folding process (not shown). Thus, even when the zigzag folding is tightly performed, pasting failure does not occur, and sufficient pasting can be performed. However, the pasting may be performed after the zigzag folding process similarly to the previous embodiment.

Cushioning materials for packaging, and methods and devices for manufacturing the cushioning materials in accordance with embodiments of the present invention have been described. The present invention should not be limited by the foregoing embodiments, but various design changes are allowed in the following claims. For example, a shape of the receiving part of an article should not be limited to the shape discussed above, but may be arbitrary in response to the supported article. The terms "crest folding" and "trough folding" described in the description are relative, and are not limited to an element positioned on the downside or upside.

INDUSTRIAL APPLICABILITY

A cushioning material for packaging, and a method and a device for manufacturing the cushioning material of the present invention are useful as a cushioning material for packaging when an article such as a precision machine apt to be damaged by an external impact, and a method and a device for automatically manufacturing the cushioning material. Especially, simply folding one corrugated fiberboard can assemble perfectly recyclable cushioning material, and automatic assembling by a machine is allowed. Thus, labor and cost can be drastically reduced to improve industrial applicability.

What is claimed is:

1. A manufacturing method of a cushioning material for packaging comprising the steps of:

forming a blank by forming, in a sheet of corrugated fiberboard, a plurality of parallel folding lines for partitioning the sheet of corrugated fiberboard into a plurality of unit corrugated fiberboard (41–52) and openings for receiving an article;

folding the blank (10) alternately oppositely along the folding lines in a zigzag shape;

pasting joint surfaces of the unit corrugated fiberboard (41–52) inter-coupled in the zigzag shape; and pressing and inter-joining the pasted unit corrugated fiberboard (41–52) to form a laminated body;

wherein the step of folding the blank further comprises a step of sequentially folding the blank (10) along the folding lines by a cooperation of a single crest folding plate (109) moving vertically and laterally and a single trough folding plate (125) moving laterally, the crest folding plate (109) being disposed on one side of a conveying route of the blank (10), the trough folding plate (125) being disposed on the other side of the conveying route.

2. A manufacturing method of a cushioning material for packaging according to claim 1, wherein the step of pasting further comprises a step of pasting the joint surfaces of the inter-coupled unit corrugated fiberboard with pasting nozzles (82, 83), the pasting nozzles (82, 83) being disposed on both sides of the conveying route of the zigzag-folded blank (10).

3. A manufacturing method of a cushioning material for packaging according to claim 1, wherein the step of folding the blank further comprises a step of reversing a relation between a crest folding and a trough folding of the folding lines of the blank to provide mutually bilaterally symmetric cushioning materials (58, 59).

* * * * *